United States Patent [19]

Hsu

[11] Patent Number: 4,959,983

[45] Date of Patent: Oct. 2, 1990

[54] SPARE KEYS AND CARD FOR RETAINING THEM

[76] Inventor: Ming-Huei Hsu, 3F, No. 51, Alley 25, Lane 639 Ming Sheng East Road, Taipei, Taiwan

[21] Appl. No.: 461,619

[22] Filed: Jan. 8, 1990

[51] Int. Cl.[5] ..... A47G 29/10

[52] U.S. Cl. ..... 70/456 R; 70/459; 70/408

[58] Field of Search ..... 70/456 R, 459, 457, 70/458, 408; D3/61, 62; 206/37–37.8

[56] References Cited

U.S. PATENT DOCUMENTS 2,734,624 2/1956 Kernicki ..... 70/456 R 4,677,835 7/1987 Almblad ..... 70/456 R

*Primary Examiner*—Robert L. Wolfe

*Attorney, Agent, or Firm*—Ho & Cho

[57] ABSTRACT

A spare keys and retaining card set for automobiles and/or for other purpose locks mainly consists of a plurality of spare keys and a retaining card. Each spare key may be inset into the retaining card within a key shaped hollow and may be easily removed out of the hollow and the card, accordingly, for use by the user. The retaining card has a size similar to that of a name card and can be put into a wallet or a pocket for easy carry. Whenever the original key is lost or is not carried with the user, the spare key may timely resolve the problem to open a door.

5 Claims, 4 Drawing Sheets

SPARE KEYS AND CARD FOR RETAINING THEM

BACKGROUND OF THE INVENTION

The present invention relates to spare keys for automobiles and/or for other purposes which may be retained on a card similar to a name card and can be put into a wallet or a pocket together with other things. Similar products may be seen in commercial markets, such as the disclosure as described in U.S. Pat. No. 4,637,236 in a spare key card. Some of these spare keys and retaining cards are matched with small protubelances and sunk spots while others are matched with tongues and grooves. Among them, the combining force between spare keys and cards formed by protubelances and sunk spots is weak and the keys are easily detachable from the cards. As for those spare keys and cards combined with tongues and grooves will take a lot of efforts to align the tongues and grooves which causes much inconvenience.

SUMMARY OF THE INVENTION

The present invention provides a spare keys retaining card on which a plurality of hollows are formed with different key profiles so that they may retain spare keys with different shapes. At the upper portion of the hollows formed on the retaining card, a retaining plate is provided, and a flexible projected button is further provided on the retaining plate. At the upper portion of the head of the spare keys, a sunken flat surface is formed and a round hole is further formed on this sunken surface. When the spare keys are placed into the key hollows, the sunken surfaces may adequately seated on the retaining plate with the projected button adequately insets into the round hole. By this way, the spare keys are removably fixed on the retaining card.

At the top of the retaining plate near the upper edge of the card, two projected blocks are spacedly disposed in a downward dent formed on the upper edge of the card and to divide the dent into three open spaces. On each of the two outside faces of the projected blocks in opposite direction, a sunk spot is formed. On the top of the spare keys, three lugs are formed and can seperately inset into the three open spaces on the retaining card. On each of the inner surfaces of the two outside lugs, a buldge is formed and can inset into the sunk spots formed on the projected block.

Moreover, a dent is formed at the root portion of the key way portion of the spare key. In case a spare key is broken when it is in use, this dent will make the crack start from the dent and continues toward the key head so that a longer broken key will stay out of the key hole to facilitate the taking out of the whole broken key.

The present invention can be best understood through the following description and accompanying drawings wherein:

DETAILED DESCRIPTION OF THE PREFERRED EMBODIMENT

Figure 1:
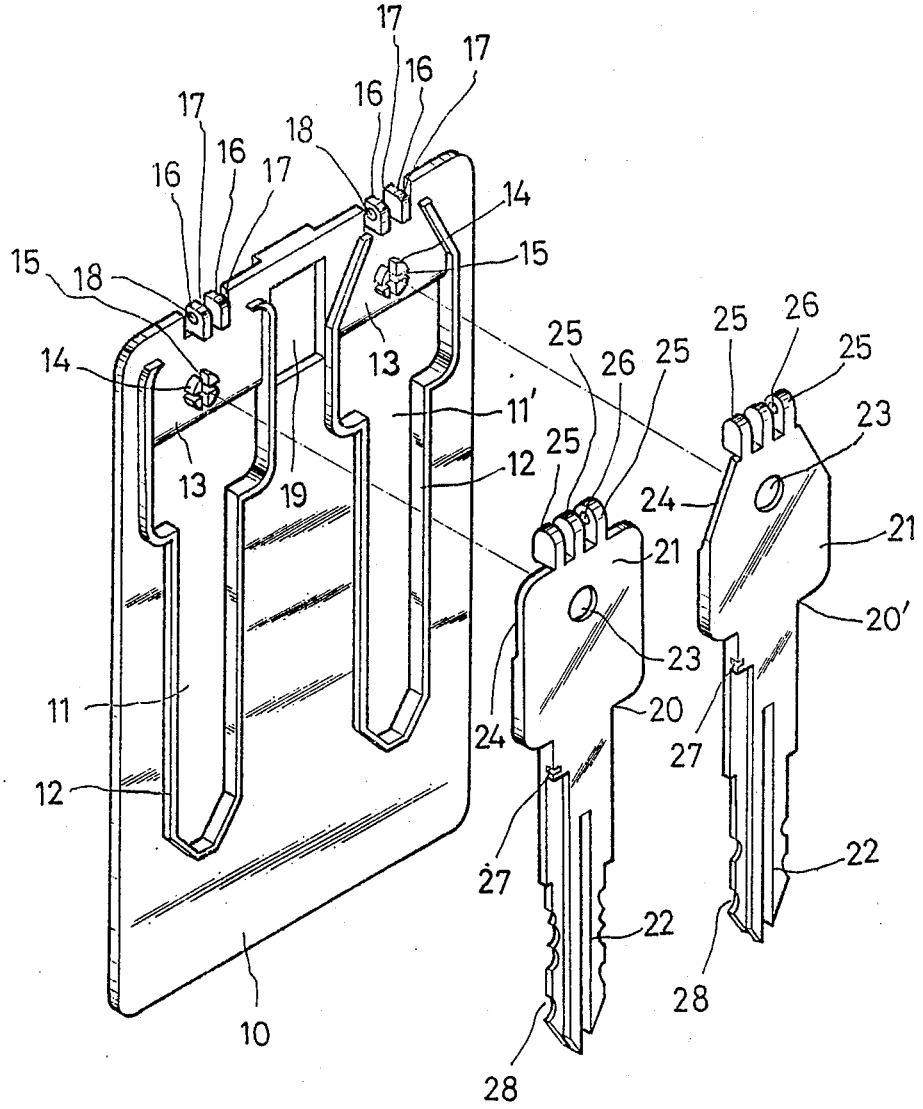
FIG. 1 is a three-dimensional analytical perspective of a preferred embodiment of the present invention.
Figure 2:
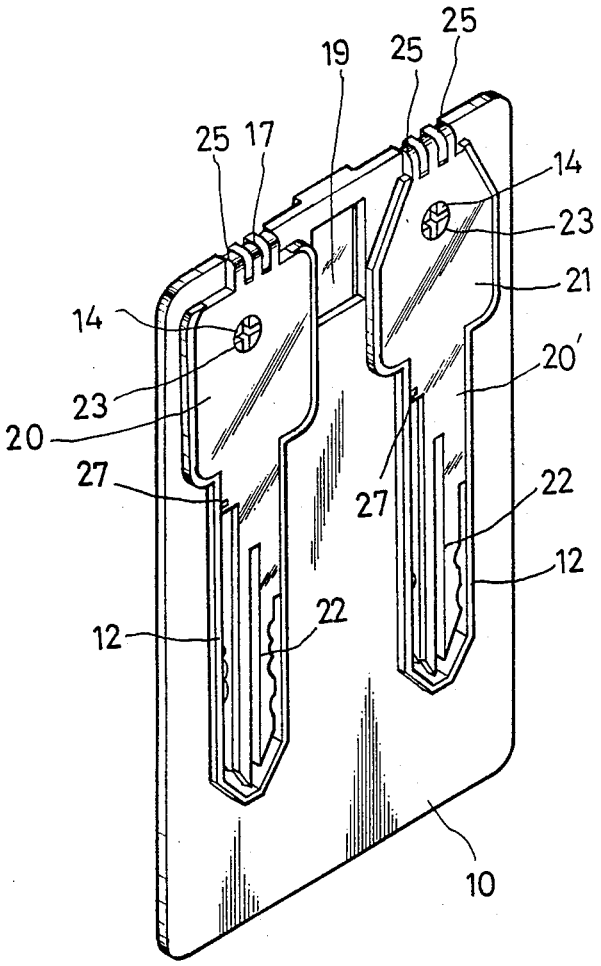
FIG. 2 is a three-dimensional perspective of the present invention.

Please refer to FIG. 1 and FIG. 2, the present invention mainly includes a retaining card 10, and a plurality of spare keys 20, 20'. All these members can be made of plastic material, such as ABS.

Figure 4:
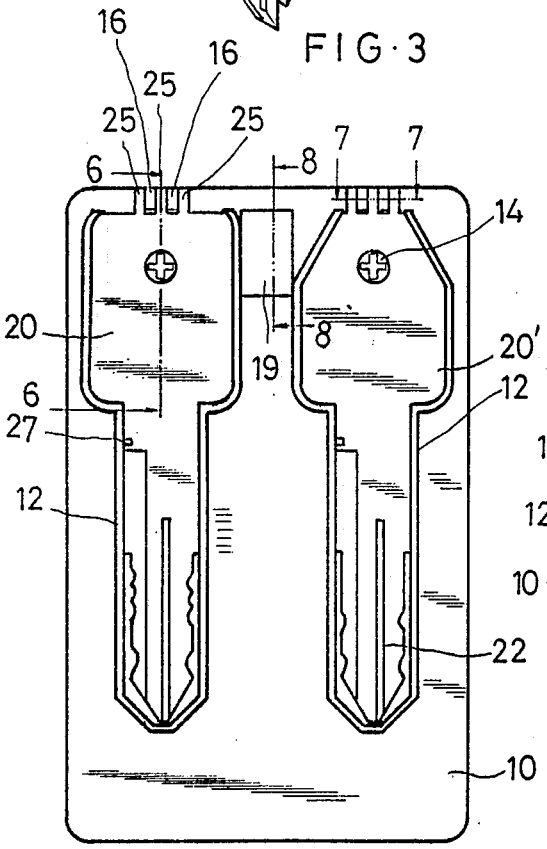
FIG. 4 is a front view of the present invention.

The retaining card 10 is generally the same as a name card in shape and in size with a plurality of key profile hollows 11, 11'. The periphery of the hollows 11, 11' have a flange 12 making the depth of the key profile hollows the same as the thickness of the spare keys 20, 20'. At the top portion of each key profile hollow 11, 11', a retaining plate 13 is provided, and a projected button 14 is further provided within the retaining plate. Please refer to FIG. 4, the projected button 14 has a substantially round circumference but is actually divided into four parts and a cross-gap 15 is formed at the center of the button 14. At the top portion of the key profile hollow 11, 11' near the top of the retaining card 10, two projected blocks 16 and spacedly disposed in a dent formed at the central portion of the top edge of the retaining card and form three open spaces 17 within the dent on the retaining card. On each outside surface of the two projected blocks, a sunk spot 18 is formed.

Figure 3:
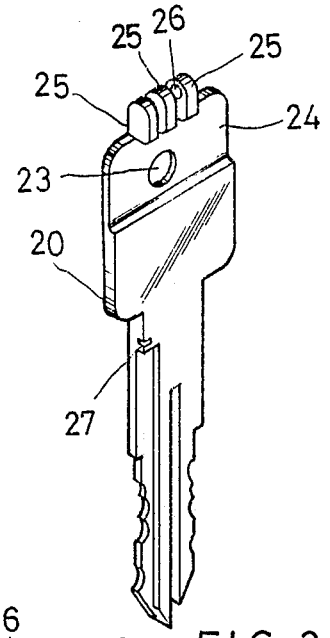
FIG. 3 is a three-dimensional perspective of a spare key as described in the present invention.

Please refer to FIG. 3, the spare key 20 mainly includes a key head 21 and a key way portion 22. At an upper portion of the back of the key head 21, a sunken flat face 24 is formed, and a round hole 23 is further formed within the sunken face 24. At the top edge of the key head 21, three lugs 25 are provided; and at each inner surface of the two outside lugs 25, a buldge 26 is formed. Moreover, a dent 27 is formed at the root portion of the key way portion 22. Except for the shape of key head and the dents on the key way portion, the spare keys are general the same in other characteristics.

The spare keys 20 may be inset into the key profile hollow 11 formed on the retaining card 10. When the spare key 20 is inset into the hollow 11, the total thickness of the retaining plate 13 plus the sunken surface 24 at the back of the key head 21 is equal to that of the spare key 20, and the projected button 14 may pass through the round hole 23; moreover, the three lugs 25 on the key 20 can adequately inset into the three open spaces 17 formed on the card dent by the two projected blocks 16. The lugs 25 and the projected blocks 16 are closely connected when the buldges 26 inset into the sunk spots 18.

Figure 6:
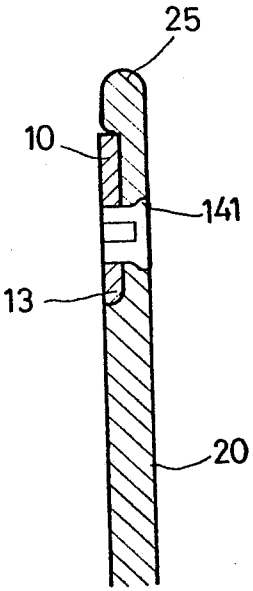
FIG. 6 is a fragmentary cross-sectional view taken on line 6—6 of FIG. 4.

Please refer to FIG. 6, each of the four parts of the projected button 14 is formed with a flange 141. When the projected button 14 is inset into the round hole 23, its four parts will be pressed to retract inwardly. When the projected button 14 has passed through the round hole 23, the flange 141 will project out the round hole 23 to secure the spare key 20 onto the retaining plate 13 and the retaining card 10, accordingly.

Figure 5:
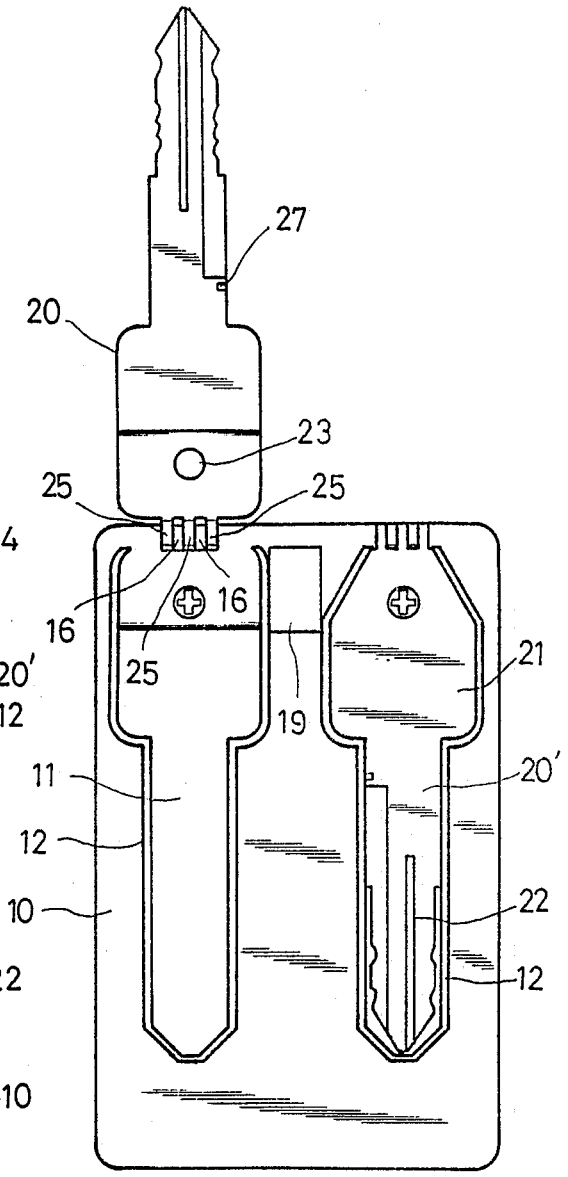
FIG. 5 shows how the spare keys are removed from the retaining card of the present invention.

To remove the spare key 20 from the retaining card 10, simply slightly thrust the key way portion 22 with a finger from the back of the card 10, then pull the key way portion 22 upward with another finger. At this point, the projected button 14 will detach from the round hole 23, the spare key 20 may be pivotly turned upward with the buldges 26 on the lugs 25 as the bearing point (pivot axle) as shown in FIG. 5. A further slightly pull will remove the spare key 20 from the retaining card 10. To combine the spare key 20 and the retaining card 10, simply align the projected button 14 with the round hole 23 and press the spare key 20, the projected blocks 16 will closely connect with the lugs 25 when the buldges 26 on the lugs 25 inset into the sunk spots 18 on the projected blocks 16.

Figure 9:
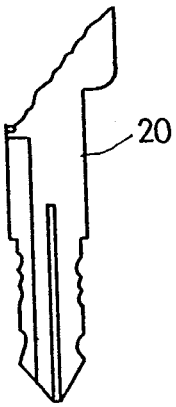
FIG. 9 shows a broken key might appear in the present invention.
Figure 8:
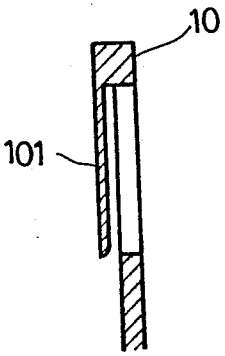
FIG. 8 is a fragmentary cross-sectional view taken on line 8—8 of FIG. 4.
Figure 7:
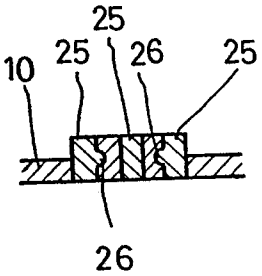
FIG. 7 is a fragmentary cross-sectional view taken on line 7—7 of FIG. 4.

The members of the present invention may be made of high rigidity plastic material. However, to prevent the key way portion 22 of the spare key 20 from being retained in the key hole in case the spare key 20 is broken, a dent 27 is formed at the root portion of the key way portion 22. By this way, a point with lowest torsional strength will be formed around the dent 27. In the event the spare key 20 is broken due to over-twist, the crack so formed would extend from the dent 27 toward the key head 21, as shown in FIG. 9. The still connecting portion of key head 21 and key way portion 22 projecting out of the key hole shall be more easy for a user to get the broken key out of the key hole.

For easy carry, the retaining card 10 may be set with a clip means 101 on the back so that it may be clipped with other things of similar size.

I claim:

1. A set of spare keys and retaining card comprising a retaining card having a plurality of key profile hollows formed within it, and a plurality of spare keys which mainly consists of a key head and a key way portion;

said key profile hollows of said retaining card being provided with a flange around their periphery, said key profile hollows having a retaining plate formed on its upper portion therein a substantially round projected button is formed;

said retaining card having two projected blocks disposed in a dent formed near the center of the upper edge of said retaining card to divide said dent into three spaces;

said two projected blocks having a sunk spot on each of their outside surface in opposite direction;

said spare keys having similar profile as the key profile hollows seperately, and having a sunken flat surface formed at the back of the key head of each said spare keys wherein a round hole is formed;

said spare keys having three lugs on their top edge while the two outside lugs have a buldge on their inner surface;

said spare keys being adequately insetable into said key profile hollows seperately and said retaining plate being adequately matched with said sunken flat surface on the back of said key head; said round hole within the sunken surface being engageable with said projected button, and said three lugs on said spare key being able to inset into said three spaces formed by said two projected blocks disposed on said retaining card with said two buldges engaged with said two sunk spots.

2. The spare keys and retaining card set as claimed in claim 1 wherein the thickness of said spare keys is the same as that of the periphery of said key profile hollows.

3. The spare keys and retaining card set as claimed in claim 1 wherein the total thickness of said retaining plate plus said sunken surface of said key head is equal to the thickness of said spare key.

4. The spare keys and retaining card set as claimed in claim 1 wherein said projected button on said retaining plate is comprises of four parts which form a cross-gap within said projected button, and each of said four parts has a flange formed at its top outer periphery.

5. The spare keys and retaining card set as claimed in claim 1 wherein a dent is formed at a root portion of said key way portion.

* * * * *